US008230951B2

(12) United States Patent
Radford et al.

(10) Patent No.: US 8,230,951 B2
(45) Date of Patent: Jul. 31, 2012

(54) EARTH-BORING TOOLS HAVING EXPANDABLE MEMBERS AND METHODS OF MAKING AND USING SUCH EARTH-BORING TOOLS

(75) Inventors: Steven R. Radford, The Woodlands, TX (US); Khoi Q. Trinh, Pearland, TX (US); Li Li, Spring, TX (US); Mark E. Anderson, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 226 days.

(21) Appl. No.: 12/570,464

(22) Filed: Sep. 30, 2009

(65) Prior Publication Data

US 2011/0073376 A1 Mar. 31, 2011

(51) Int. Cl.
*E21B 10/32* (2006.01)

(52) U.S. Cl. ..... 175/267; 175/285

(58) Field of Classification Search ..... 175/267, 175/268, 269, 285, 291
See application file for complete search history.

(56) References Cited

U.S. PATENT DOCUMENTS

| | | | |
|---|---|---|---|
| 3,224,507 | A | 12/1965 | Cordary et al. |
| 4,091,883 | A | 5/1978 | Weber |
| 4,282,941 | A | 8/1981 | Perkin |
| 4,282,942 | A | 8/1981 | Longmore |
| 4,407,377 | A | 10/1983 | Russell |
| 4,431,065 | A | 2/1984 | Andrews |
| 4,458,761 | A | 7/1984 | Van Vreeswyk |
| 4,635,738 | A | 1/1987 | Schillinger et al. |
| 4,660,657 | A | 4/1987 | Furse et al. |
| 4,711,326 | A | 12/1987 | Baugh et al. |
| 5,175,429 | A | 12/1992 | Hall, Jr. et al. |
| 5,201,817 | A | 4/1993 | Hailey |
| 5,402,856 | A | 4/1995 | Warren et al. |
| 5,495,899 | A | 3/1996 | Pastusek et al. |
| 5,853,054 | A | 12/1998 | McGarian et al. |
| 5,957,223 | A | 9/1999 | Doster et al. |

(Continued)

FOREIGN PATENT DOCUMENTS

GB 2420803 A 6/2006

(Continued)

OTHER PUBLICATIONS

Radford, Steven, et al., "Novel Concentric Expandable Stabilizer Results in Increased Penetration Rates and Drilling Efficiency with Reduced Vibration," Copyright 2009, SPE/IADC Drilling Conference and Exhibition, SPE/IADC 119534, pp. 1-13.

(Continued)

*Primary Examiner* — Daniel P Stephenson
(74) *Attorney, Agent, or Firm* — TraskBritt

(57) ABSTRACT

An expandable apparatus for use in a borehole includes a tubular body having at least one opening extending between a longitudinal bore of the tubular body and an outer surface of the tubular body and at least one member positioned within the at least one opening of the tubular body. The at least one member is configured to move between a retracted position and an extended position. An actuation structure is positioned within the tubular body. The actuation structure is coupled to the at least one member and is configured to move the at least one member from the retracted position to the extended position responsive to a flow rate of drilling fluid passing through the longitudinal bore.

24 Claims, 13 Drawing Sheets

U.S. PATENT DOCUMENTS

| | | | | |
|---|---|---|---|---|
| RE36,817 | E | 8/2000 | Pastusek et al. | |
| 6,142,248 | A | 11/2000 | Thigpen et al. | |
| 6,360,831 | B1 | 3/2002 | Akesson et al. | |
| 6,615,933 | B1 | 9/2003 | Eddison | |
| 6,668,949 | B1 | 12/2003 | Rives | |
| 6,732,817 | B2 | 5/2004 | Dewey et al. | |
| 6,880,650 | B2 | 4/2005 | Hoffmaster et al. | |
| 7,036,611 | B2 | 5/2006 | Radford et al. | |
| 7,252,163 | B2 | 8/2007 | Ollerenshaw et al. | |
| 7,308,937 | B2 | 12/2007 | Radford et al. | |
| 7,314,099 | B2 | 1/2008 | Dewey et al. | |
| 7,325,630 | B2 * | 2/2008 | Takhaundinov et al. | 175/269 |
| 7,493,971 | B2 | 2/2009 | Nevlud et al. | |
| 7,549,485 | B2 | 6/2009 | Radford et al. | |
| 7,658,241 | B2 * | 2/2010 | Lassoie et al. | 175/57 |
| 2005/0145417 | A1 * | 7/2005 | Radford et al. | 175/57 |
| 2007/0089912 | A1 | 4/2007 | Eddison et al. | |
| 2008/0105464 | A1 | 5/2008 | Radford | |
| 2008/0105465 | A1 | 5/2008 | Radford et al. | |
| 2008/0110678 | A1 | 5/2008 | Radford et al. | |
| 2008/0128169 | A1 * | 6/2008 | Radford et al. | 175/57 |
| 2008/0128174 | A1 | 6/2008 | Radford et al. | |
| 2008/0128175 | A1 | 6/2008 | Radford et al. | |
| 2009/0114448 | A1 | 5/2009 | Laird et al. | |

FOREIGN PATENT DOCUMENTS

| | | | |
|---|---|---|---|
| WO | 2004097163 | A1 | 11/2004 |
| WO | 2008070038 | A1 | 6/2008 |

OTHER PUBLICATIONS

International Search Report for International Application No. PCT/US2010/049677 mailed Apr. 26, 2011, 3 pages.

International Written Opinion for International Application No. PCT/US2010/049677 mailed Apr. 26, 2011, 4 pages.

International Preliminary Report on Patentability for International Application No. PCT/US2010/049677 dated Apr. 3, 2012, 6 pages.

* cited by examiner

100

EARTH-BORING TOOLS HAVING EXPANDABLE MEMBERS AND METHODS OF MAKING AND USING SUCH EARTH-BORING TOOLS

TECHNICAL FIELD

Embodiments of the present invention relate generally to an expandable apparatus for use in a subterranean borehole and, more particularly, to an expandable reamer apparatus for enlarging a subterranean borehole beneath a casing or liner and to an expandable stabilizer apparatus for stabilizing a bottom-hole assembly during a drilling operation.

BACKGROUND

Expandable reamers are typically employed for enlarging subterranean boreholes. Conventionally, in drilling oil, gas, and geothermal wells, casing is installed and cemented to prevent well bore walls from caving into the subterranean borehole while providing requisite shoring for subsequent drilling operation to achieve greater depths. Casing is also conventionally installed to isolate different formations, to prevent cross-flow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, which is assigned to the assignee of the present invention. A bi-center bit assembly employs two longitudinally superimposed bit sections with laterally offset axes, which, when rotated, produce an enlarged borehole diameter. An example of a bi-center bit is disclosed in U.S. Pat. No. 5,957,223, which is also assigned to the assignee of the present invention.

Another conventional approach used to enlarge a subterranean borehole includes employing an extended bottom-hole assembly with a pilot drill bit at the distal end thereof and a reamer assembly some distance above the pilot drill bit. This arrangement permits the use of any conventional rotary drill bit type (e.g., a rock bit or a drag bit), as the pilot bit and the extended nature of the assembly permit greater flexibility when passing through tight spots in the borehole as well as the opportunity to effectively stabilize the pilot drill bit so that the pilot drill bit and the following reamer will traverse the path intended for the borehole. This aspect of an extended bottom-hole assembly is particularly significant in directional drilling. The assignee of the present invention has, to this end, designed as reaming structures so called "reamer wings," which generally comprise a tubular body having a fishing neck with a threaded connection at the top thereof and a tong die surface at the bottom thereof, also with a threaded connection. U.S. Pat. Nos. RE 36,817 and 5,495,899, both of which are assigned to the assignee of the present invention; disclose reaming structures including reamer wings. The upper midportion of the reamer wing tool includes one or more longitudinally extending blades projecting generally radially outwardly from the tubular body, and PDC cutting elements are provided on the blades.

As mentioned above, conventional expandable reamers may be used to enlarge a subterranean borehole and may include blades that are pivotably or hingedly affixed to a tubular body and actuated by way of a piston disposed therein as disclosed by, for example, U.S. Pat. No. 5,402,856 to Warren. In addition, U.S. Pat. No. 6,360,831 to Åkesson et al. discloses a conventional borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string, and, once the tool has passed beyond the end of the casing, the blades are extended so the bore diameter may be increased below the casing.

BRIEF SUMMARY

In some embodiments, the present invention includes expandable apparatus for use in a subterranean borehole. The expandable apparatus include a tubular body having at least one opening extending between a longitudinal bore of the tubular body and an outer surface of the tubular body, and at least one member positioned within the at least one opening of the tubular body. The at least one member is configured to move between a retracted position and an extended position. A push sleeve is disposed within the longitudinal bore of the tubular body and coupled to the at least one member. The push sleeve is configured to move the at least one member from the retracted position to the extended position responsive to a flow rate of drilling fluid passing through the longitudinal bore. A traveling sleeve is positioned within the longitudinal bore of the tubular body and partially within the push sleeve. The traveling sleeve is configured to secure the push sleeve from axial movement within the tubular body in an initial position. A lower sub is coupled to the tubular body. The lower sub has a longitudinal bore sized and configured to enable the traveling sleeve to translate through the longitudinal bore of the tubular body and into the longitudinal bore of the lower sub.

In additional embodiments, the present invention includes expandable apparatus for use in a subterranean borehole. The expandable apparatus include a tubular body having at least one opening extending between a longitudinal bore of the tubular body and an outer surface of the tubular body, and at least one member positioned within the at least one opening of the tubular body. The at least one member is configured to move between a retracted position and an extended position. A push sleeve is disposed within the longitudinal bore of the tubular body and coupled to the at least one member. The push sleeve is configured to move the at least one member from the retracted position to the extended position responsive to a flow rate of drilling fluid passing through the longitudinal bore. A traveling sleeve is positioned within the longitudinal bore of the tubular body and partially within the push sleeve. The traveling sleeve is configured to secure the push sleeve from axial movement within the tubular body in an initial position. An uplock sleeve is coupled to the traveling sleeve.

The uplock sleeve is configured to secure the traveling sleeve from axial movement within the tubular body in the initial position. A distal portion of the uplock sleeve comprises a first seal ring disposed between an outer surface of the uplock sleeve and an inner surface of the tubular body.

In yet additional embodiments, the present invention includes expandable apparatus for use in a subterranean borehole. The expandable apparatus include a tubular body having at least one opening extending between a longitudinal bore of the tubular body and an outer surface of the tubular body, and at least one member positioned within the at least one opening of the tubular body. The at least one member is configured to move between a retracted position and an extended position. A push sleeve is disposed within the longitudinal bore of the tubular body and coupled to the at least one member. The push sleeve is configured to move the at least one member from the retracted position to the extended position responsive to a flow rate of drilling fluid passing through the longitudinal bore. A traveling sleeve is positioned within the longitudinal bore of the tubular body and partially within the push sleeve. The traveling sleeve is configured to secure the push sleeve from axial movement within the tubular body in an initial position. A preloaded spring is disposed within the longitudinal bore of the tubular body and abuts a portion of the push sleeve. The preloaded spring biases the push sleeve and the at least one member coupled thereto in a retracted position.

In yet additional embodiments, the present invention includes expandable apparatus for use in a subterranean borehole. The expandable apparatus include a tubular body having at least one opening extending between a longitudinal bore of the tubular body and an outer surface of the tubular body, and at least one member positioned within the at least one opening of the tubular body. The at least one member is configured to move between a retracted position and an extended position. An actuation structure is positioned within the tubular body. The actuation structure is coupled to the at least one member and is configured to move the at least one member from the retracted position to the extended position responsive to a flow rate of drilling fluid passing through the longitudinal bore. At least one nozzle assembly is positioned in the tubular body proximate to the at least one member. The at least one nozzle assembly extends to the longitudinal bore of the tubular body.

In yet additional embodiments, the present invention includes expandable apparatus for use in a subterranean borehole. The expandable apparatus include a tubular body having at least one opening extending between a longitudinal bore of the tubular body and an outer surface of the tubular body, and at least one member positioned within the at least one opening of the tubular body. The at least one member is configured to move between a retracted position and an extended position. An actuation structure is positioned within the tubular body. The actuation structure is coupled to the at least one member and is configured to move the at least one member from the retracted position to the extended position responsive to a flow rate of drilling fluid passing through the longitudinal bore. A sealing ring is disposed in an inner surface of the tubular body and abuts a portion of the actuation structure.

In further embodiments, the expandable apparatus may comprise at least one of an expandable reamer apparatus and an expandable stabilizer apparatus.

BRIEF DESCRIPTION OF THE DRAWINGS

While the specification concludes with claims particularly pointing out and distinctly claiming what are regarded as embodiments of the invention, various features and advantages of embodiments of the invention may be more readily ascertained from the following description of some embodiments of the invention, when read in conjunction with the accompanying drawings, in which:

DETAILED DESCRIPTION

The illustrations presented herein are, in some instances, not actual views of any particular earth-boring tool, expandable apparatus, cutting element, or other feature of an earth-boring tool, but are merely idealized representations that are employed to describe embodiments of the present invention. Additionally, elements common between figures may retain the same numerical designation.

As used herein, the terms "distal" and "proximal" are relative terms used to describe portions of an expandable apparatus, sleeve, or sub with reference to the surface of a formation to be drilled. A "distal" portion of an expandable apparatus, sleeve, or sub is the portion relatively more distant from the surface of the formation when the expandable apparatus, sleeve, or sub is disposed in a well bore extending into the formation during a drilling or reaming operation. A "proximal" portion of an expandable apparatus, sleeve, or sub is the portion in closer relative proximity to the surface of the formation when the expandable apparatus, sleeve, or sub is disposed in a well bore extending into the formation during a drilling or reaming operation.

In some embodiments, the expandable apparatus described herein may be similar to the expandable apparatus described in United States Patent Application Publication No. US 2008/0128175 A1, which application was filed Dec. 3, 2007 and entitled "Expandable Reamers for Earth-Boring Applications," the entire disclosure of which is incorporated herein by reference.

Figure 1:
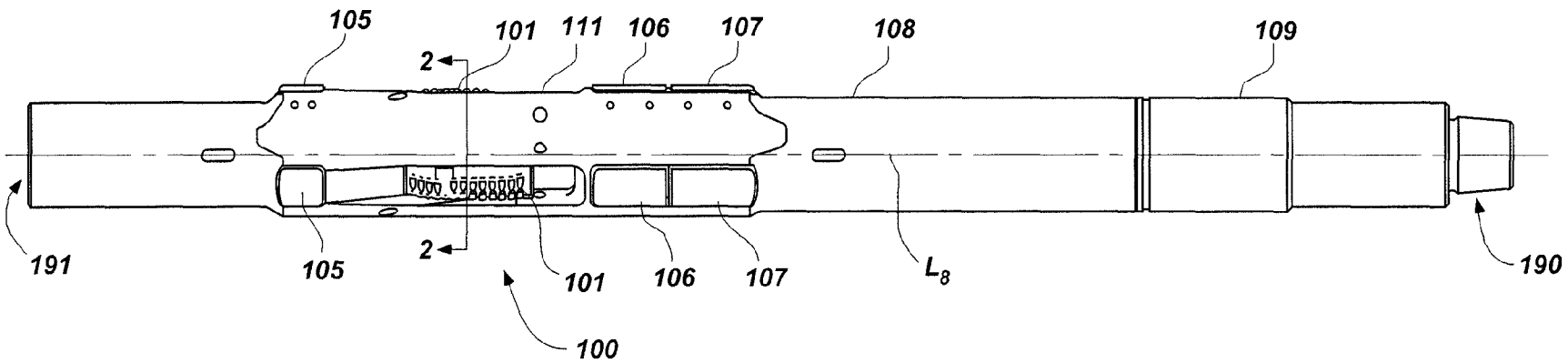
FIG. 1 is a side view of an embodiment of an expandable reamer apparatus of the invention.

An embodiment of an expandable apparatus (e.g., an expandable reamer apparatus 100) of the invention is shown in FIG. 1. The expandable reamer apparatus 100 may include a generally cylindrical tubular body 108 having a longitudinal axis $L_8$. The tubular body 108 of the expandable reamer apparatus 100 may have a distal end 190, a proximal end 191, and an outer surface 111. The distal end 190 of the tubular body 108 of the expandable reamer apparatus 100 may include a set of threads (e.g., a threaded male pin member) for connecting the distal end 190 to another section of a drill string or another component of a bottom-hole assembly (BHA), such as, for example, a drill collar or collars carrying a pilot drill bit for drilling a well bore. In some embodiments, the expandable reamer apparatus 100 may include a lower sub 109 that connects to the lower box connection of the tubular body 108. Similarly, the proximal end 191 of the tubular body 108 of the expandable reamer apparatus 100 may include a set of threads (e.g., a threaded female box member) for connecting the proximal end 191 to another section of a drill string (e.g., an upper sub (not shown)) or another component of a bottom-hole assembly (BHA).

Figure 11:
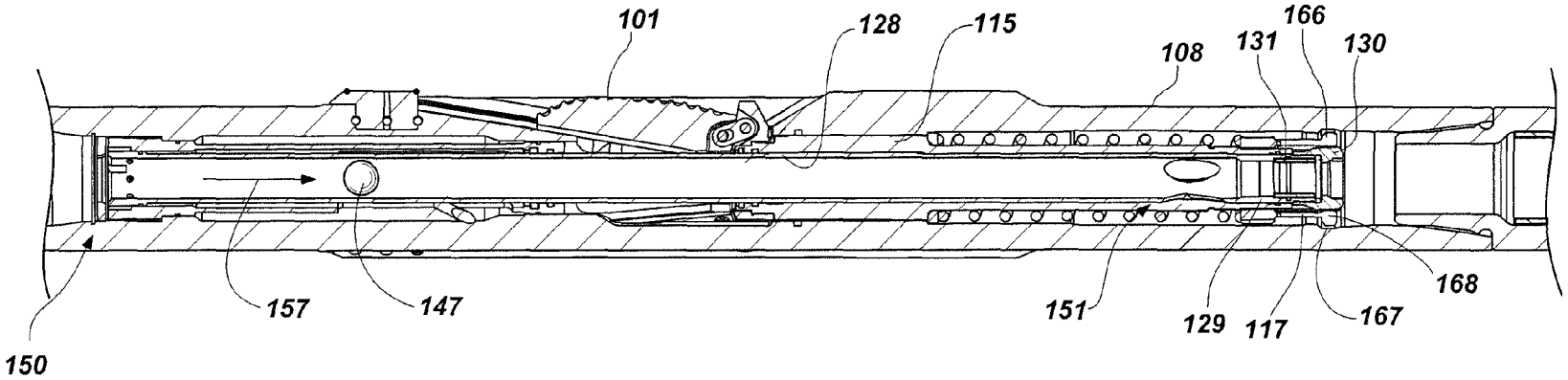
FIG. 11 shows a partial, longitudinal cross-sectional illustration of an embodiment of an expandable reamer apparatus in a closed, or retracted, initial tool position.

Three sliding members (e.g., blades 101, stabilizer blocks, etc.) are positionally retained in circumferentially spaced relationship in the tubular body 108 as further described below and may be provided at a position along the expandable reamer apparatus 100 intermediate the first distal end 190 and the second proximal end 191. The blades 101 may be comprised of steel, tungsten carbide, a particle-matrix composite material (e.g., hard particles dispersed throughout a metal matrix material), or other suitable materials as known in the art. The blades 101 are retained in an initial, retracted position within the tubular body 108 of the expandable reamer apparatus 100 as illustrated in FIG. 11, but may be moved responsive to application of hydraulic pressure into the extended position (shown in FIG. 14) and moved into a retracted position (shown in FIG. 15) when desired, as will be described herein. The expandable reamer apparatus 100 may be configured such that the blades 101 engage the walls of a subterranean formation surrounding a well bore in which expandable reamer apparatus 100 is disposed to remove formation material when the blades 101 are in the extended position, but are not operable to engage the walls of a subterranean formation within a well bore when the blades 101 are in the retracted position. While the expandable reamer apparatus 100 includes three blades 101, it is contemplated that one, two or more than three blades may be utilized to advantage. Moreover, while the blades 101 of expandable reamer apparatus 100 are symmetrically circumferentially positioned about the longitudinal axis $L_8$ along the tubular body 108, the blades 101 may also be positioned circumferentially asymmetrically as well as asymmetrically about the longitudinal axis $L_8$. The expandable reamer apparatus 100 may also include a plurality of stabilizer pads to stabilize the tubular body 108 of expandable reamer apparatus 100 during drilling or reaming processes. For example, the expandable reamer apparatus 100 may include upper hardfaced pads 105, mid hardfaced pads 106, and lower hardface pads 107.

Figure 2:
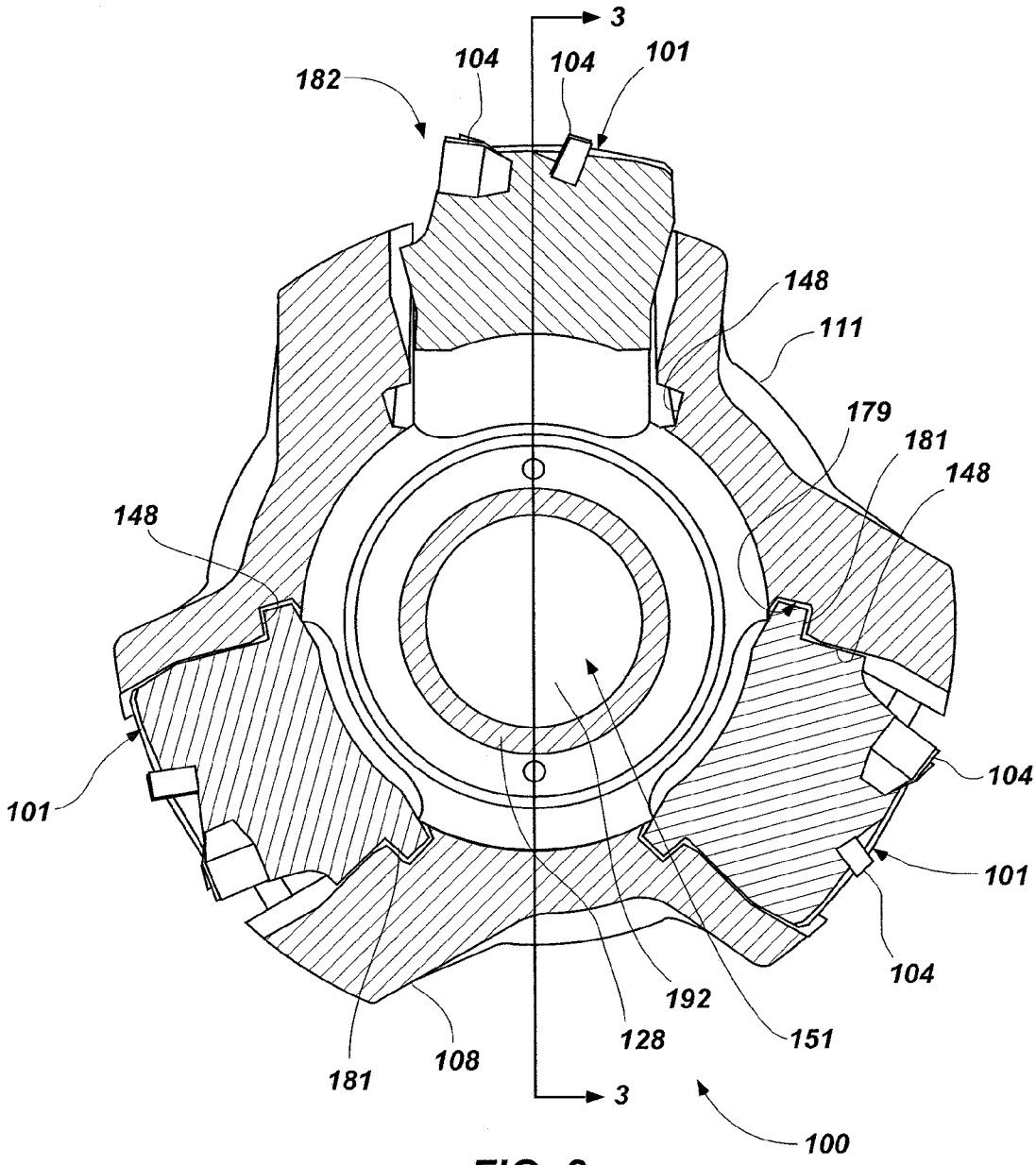
FIG. 2 shows a transverse cross-sectional view of the expandable reamer apparatus as indicated by section line 2-2 in FIG. 1.

FIG. 2 is a cross-sectional view of the expandable reamer apparatus 100 shown in FIG. 1 taken along section line 2-2 shown therein. As shown in FIG. 2, the tubular body 108 encloses a fluid passageway 192 that extends longitudinally through the tubular body 108. Fluid may travel through the fluid passageway 192 in a longitudinal bore 151 of the tubular body 108 (and a longitudinal bore of a traveling sleeve 128) in a bypassing relationship to substantially shield the blades 101 from exposure to drilling fluid, particularly in the lateral direction, or normal to the longitudinal axis $L_8$. The particulate-entrained fluid is less likely to cause build-up or interfere with the operational aspects of the expandable reamer apparatus 100 by shielding the blades 101 from exposure with the fluid. However, it is recognized that beneficial shielding of the blades 101 is not necessary to the operation of the expandable reamer apparatus 100 where, as explained in further detail below, the operation (i.e., extension from the initial position, the extended position and the retracted position) occurs by an axially directed force that is the net effect of the fluid pressure and spring biases forces. In this embodiment, the axially directed force directly actuates the blades 101 by axially influencing an actuating feature, such as a push sleeve 115 (shown in FIG. 3) for example, and without limitation, as described herein below.

Referring to FIG. 2, to better describe aspects of the invention, one of blades 101 is shown in the outward or extended position while the other blades 101 are shown in the initial or retracted positions. The expandable reamer apparatus 100 may be configured such that the outermost radial or lateral extent of each of the blades 101 is recessed within the tubular body 108 when in the initial or retracted positions so as to not extend beyond the greatest extent of an outer diameter of the tubular body 108. Such an arrangement may protect the blades 101 as the expandable reamer apparatus 100 is disposed within a casing of a borehole, and may enable the expandable reamer apparatus 100 to pass through such casing within a borehole. In other embodiments, the outermost radial extent of the blades 101 may coincide with or slightly extend beyond the outer diameter of the tubular body 108. The blades 101 may extend beyond the outer diameter of the tubular body 108 when in the extended position, to engage the walls of a borehole in a reaming operation.

The three sliding blades 101 may be retained in three blade tracks 148 formed in the tubular body 108. The blades 101 each carry a plurality of cutting elements 104 for engaging the material of a subterranean formation defining the wall of an open borehole when the blades 101 are in an extended position (shown in FIG. 14). The cutting elements 104 may be polycrystalline diamond compact (PDC) cutters or other cutting elements known in the art.

Optionally, one or more of the blades 101 may be replaced with stabilizer blocks having guides and rails as described herein for being received into grooves 179 of the track 148 in the expandable reamer apparatus 100, which may be used as an expandable concentric stabilizer rather than a reamer, which may further be utilized in a drill string with other concentric reamers or eccentric reamers.

Figure 3:
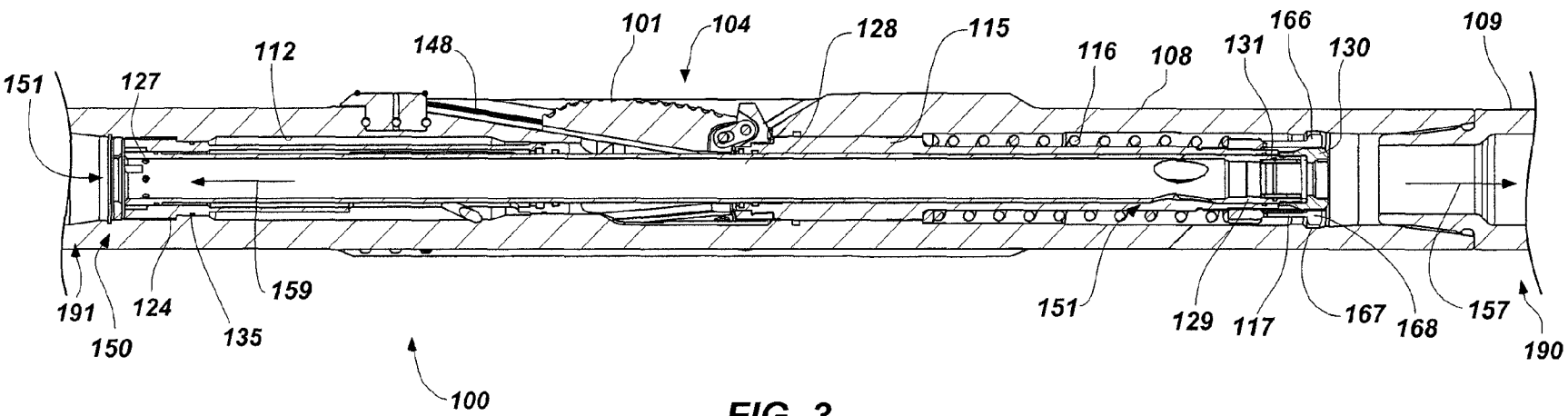
FIG. 3 shows a longitudinal cross-sectional view of the expandable reamer apparatus shown in FIG. 1.
Figure 7:
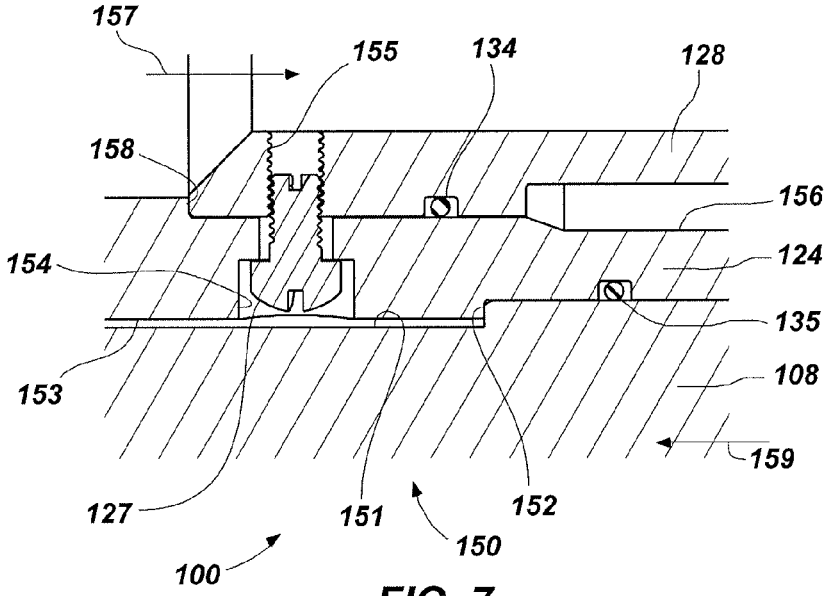
FIG. 7 shows a cross-sectional view of a shear assembly of an embodiment of an expandable reamer apparatus including a shear assembly.

FIG. 3 is another cross-sectional view of the expandable reamer apparatus 100 including blades 101 shown in FIGS. 1 and 2 taken along section line 3-3 shown in FIG. 2. The expandable reamer apparatus 100 may include a shear assembly 150 for retaining the expandable reamer apparatus 100 in the initial position by securing the traveling sleeve 128 toward the proximal end 191 of the tubular body 108. The shear assembly 150 includes an uplock sleeve 124, shear screws 127, and the traveling sleeve 128. As shown in greater detail in FIG. 7, the uplock sleeve 124 is retained within the longitudinal bore 151 of the tubular body 108 between a lip 152 and a retaining ring 132, and includes a seal 135 (e.g., an O-ring seal) to prevent fluid from flowing between an outer surface 153 of the uplock sleeve 124 and an inner surface 112 of the tubular body 108. The uplock sleeve 124 includes shear slots 154 for retaining each of the shear screws 127, where, in the current embodiment of the invention, each shear screw 127 is threaded into a shear port 155 of the traveling sleeve 128. The shear screws 127 hold the traveling sleeve 128 at least partially within the uplock sleeve 124 to conditionally prevent the traveling sleeve 128 from axially moving in a downhole direction 157 (i.e., toward the distal end 190 (FIG. 1) of the expandable reamer apparatus 100). The uplock sleeve 124 includes an inner lip 158 to prevent the traveling sleeve 128 from moving in the uphole direction 159 (i.e., toward the proximal end 191 (FIG. 1) of the expandable reamer apparatus 100). A seal 134 (e.g., an O-ring seal) seals an outer surface 162 of the traveling sleeve 128 between an inner surface 156 of the uplock sleeve 124. When the shear screws 127 are sheared, the traveling sleeve 128 may axially travel within the tubular body 108 in the downhole direction 157. In some embodiments, the portions of the shear screws 127 when sheared may be retained within the uplock sleeve 124 and the traveling sleeve 128 in order to prevent the portions from becoming loose or being lodged in other components when drilling the borehole. While shear screws 127 are shown, other shear elements may be used (e.g., a shear rod, a shear wire, a shear pin, etc.). Optionally, other shear elements may include structure for positive retention within constituent components after being exhausted, similar in manner to the shear screws 127 of the current embodiment of the invention.

Referring again to FIG. 3, the expandable reamer apparatus 100 may include a lower sub 109 that connects to the lower box connection of the tubular body 108. The lower sub 109, although not required, may provide for more efficient connection to other downhole equipment, downhole tools, etc.

Figure 4:
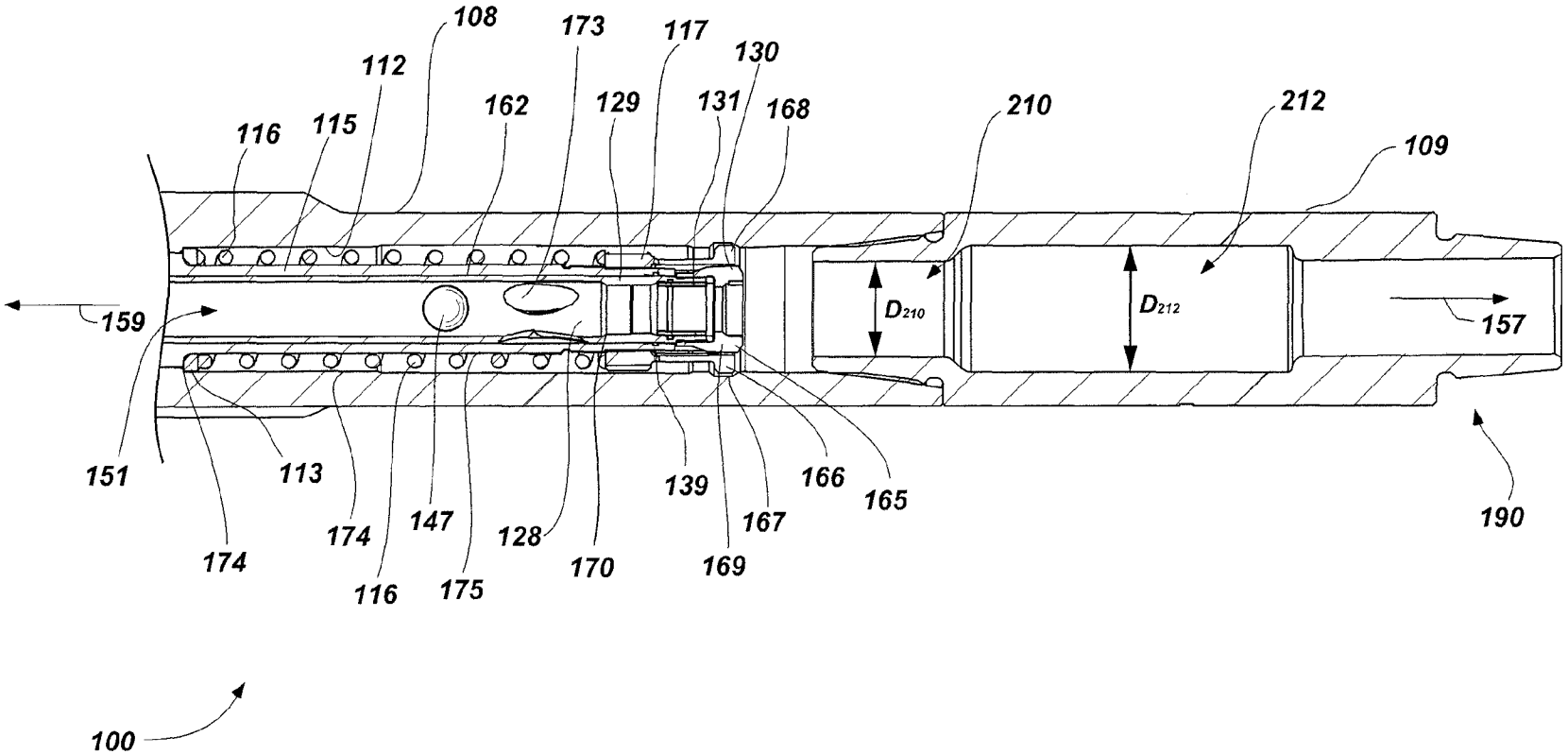
FIG. 4 shows an enlarged cross-sectional view of another portion of the expandable reamer apparatus shown in FIG. 3.

As shown in FIG. 4, a distal end 165 of the traveling sleeve 128, which includes a seat stop sleeve 130, is aligned, axially guided and supported by an annular piston or sleeve (e.g., a portion of the push sleeve 115). For example, the push sleeve 115 may include a distal portion such as, for example, the lowlock sleeve 117 that may be axially coupled to the push sleeve 115. The push sleeve 115 may be cylindrically retained between the traveling sleeve 128 and the inner surface 112 of the tubular body 108. When the traveling sleeve 128 is in the initial position during drilling, the hydraulic pressure may act on the push sleeve 115 coupled to the lowlock sleeve 117 between the outer surface 162 of the traveling sleeve 128 and the inner surface 112 of the tubular body 108. With or without hydraulic pressure, when the expandable reamer apparatus 100 is in the initial position, the push sleeve 115 is prevented from moving in the uphole direction 159 by a lowlock assembly (e.g., the push sleeve 115 is prevented from moving by one or more dogs 166 of the lowlock sleeve 117 engaged with the tubular body 108).

The dogs 166 are positionally retained between an annular groove 167 in the longitudinal bore 151 of the tubular body 108 and the seat stop sleeve 130. Each dog 166 of the lowlock sleeve 117 is a collet or locking dog latch having an expandable detent 168 that may engage the groove 167 of the tubular body 108 when compressively engaged by the seat stop sleeve 130. The dogs 166 hold the lowlock sleeve 117 in place and prevent the push sleeve 115 from moving in the uphole direction 159 until the seat stop sleeve 130, with its larger outer diameter 169, travels beyond the lowlock sleeve 117 enabling the dogs 166 to retract axially inward toward the smaller outer diameter 170 of the traveling sleeve 128. When the dogs 166 retract axially inward they may be disengaged from the groove 167 of the tubular body 108, enabling the push sleeve 115 to move responsive to hydraulic pressure primarily in the axial direction (i.e., in the uphole direction 159).

As further shown in FIG. 4, a lower sub 109 may be coupled to the tubular body 108 of the expandable reamer apparatus 100. The lower sub 109 may include a longitudinal bore 210 sized and configured to enable the traveling sleeve 128 to translate through the longitudinal bore 210 of the tubular body 108 and into the longitudinal bore 210 of the lower sub 109. For example, the longitudinal bore 210 of the lower sub 109 may have a diameter $D_{210}$. The diameter $D_{210}$ may be sized such that when the traveling sleeve 128 translates in an axial direction through the tubular body 108 (i.e., along the longitudinal axis of the tubular body 108), a distal end portion of the traveling sleeve 128 may pass through a portion of the longitudinal bore 210 of the lower sub 109. In some embodiments, a portion 212 of the longitudinal bore 210 of the lower sub 109 may have a diameter $D_{212}$ greater than a diameter of $D_{210}$ of the longitudinal bore 210 of the lower sub 109. For example, when the traveling sleeve 128 is disengaged from the push sleeve 115 to axially travel within the tubular body 108, the traveling sleeve 128 may travel through a distal end of the tubular body 108 into the lower sub 109. The relatively greater diameter $D_{212}$ of the portion 212 of the longitudinal bore 210 of the lower sub 109 enables the traveling sleeve 128 to translate through the lower sub 109 while also providing a greater area inside the portion 212 of the longitudinal bore 210 for drilling fluid to flow around the distal end of the traveling sleeve 128 when the fluid ports 173 of the traveling sleeve 128 are located in the portion 212 of the longitudinal bore 210 of the lower sub 109. The additional area provided by the diameter $D_{212}$ in the portion 212 of the longitudinal bore 210 relative to the diameter $D_{210}$ or relative to the longitudinal bore 151 of the tubular body 108 may reduce erosion caused by the drilling fluid flow through the longitudinal bore 210.

Figure 5:
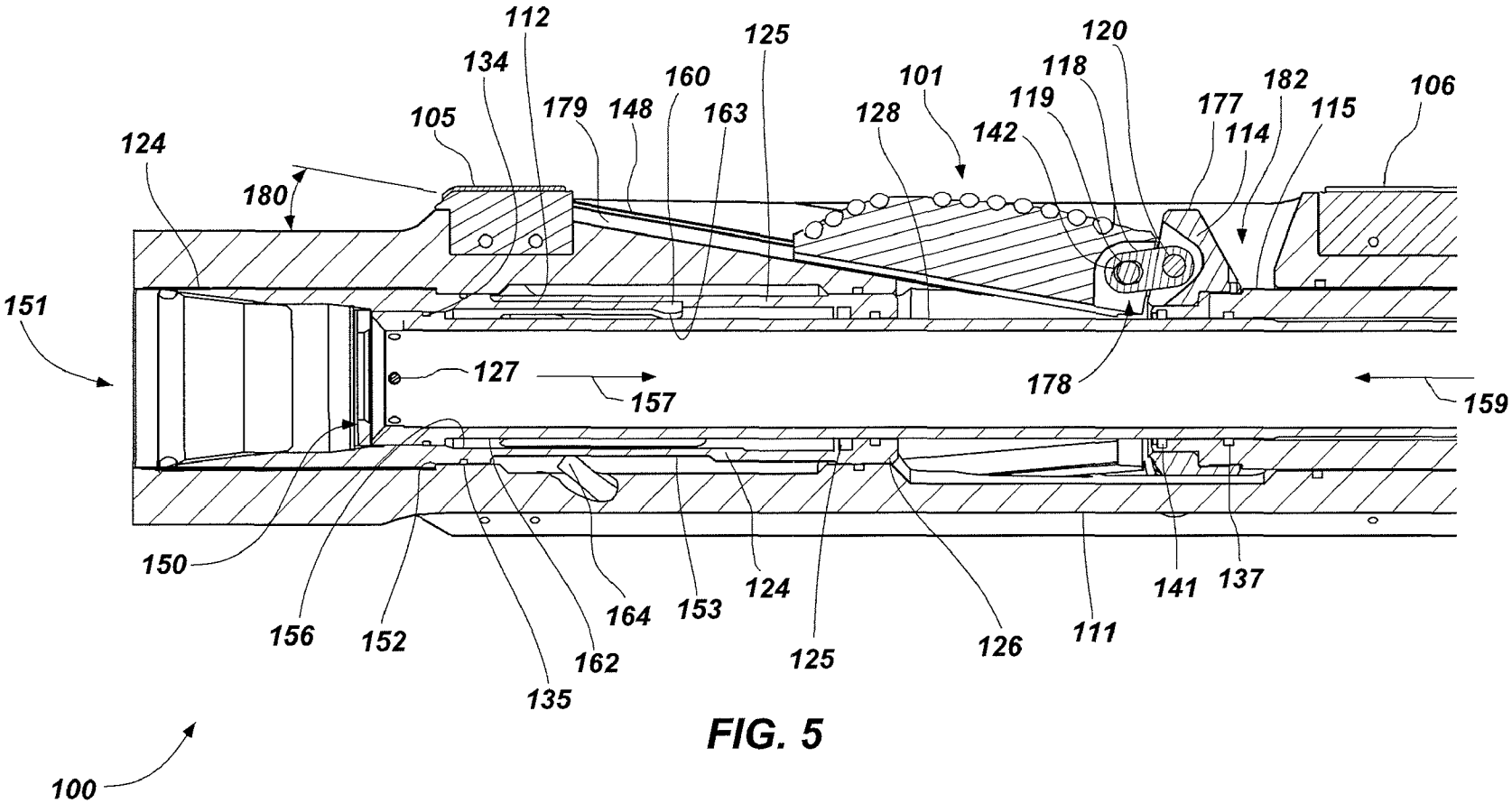
FIG. 5 shows an enlarged cross-sectional view of yet another portion of the expandable reamer apparatus shown in FIG. 3.
Figure 9:
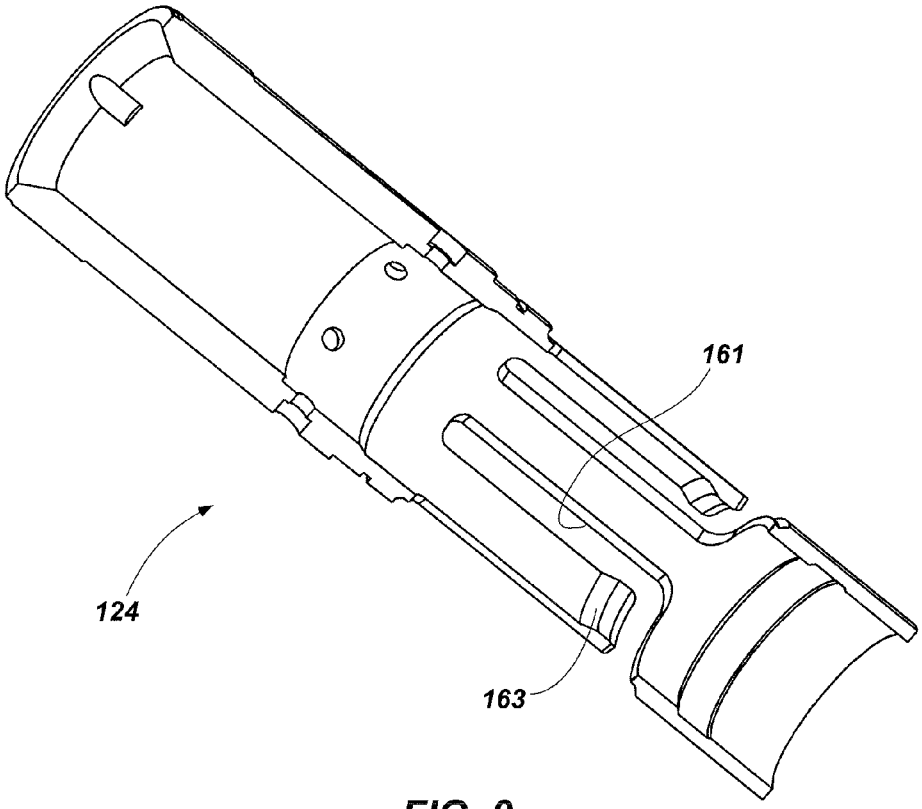
FIG. 9 shows a cross-sectional view of an uplock sleeve of an embodiment of an expandable reamer apparatus.

With reference to FIG. 5, the uplock sleeve 124 (also shown in greater detail in FIG. 9) further includes a sealing portion 126 between the inner surface 112 of the tubular body 108 and the outer surface 162 of the traveling sleeve 128. The uplock sleeve 124 also includes one or more ears 163 and one or more ports 161 axially spaced there around. When the traveling sleeve 128 positions a sufficient axial distance in the downhole direction 157, the one or more ears 163 spring radially inward to lock the motion of the traveling sleeve 128 between the ears 163 of the uplock sleeve 124 and between a shock absorbing member 125 mounted upon a proximal end of the sealing portion 126. Also, as the traveling sleeve 128 positions a sufficient axial distance in the downhole direction 157, the one or more ports 161 of the uplock sleeve 124 may enable fluid to communicate with a nozzle intake port 164 from the fluid passageway 192 (FIG. 2). The shock absorbing member 125 of the sealing portion 126 provides spring retention of the traveling sleeve 128 with the ears 163 of the uplock sleeve 124 and also mitigates impact shock caused by the traveling sleeve 128 when its motion is stopped by the sealing portion 126.

Shock absorbing member 125 may comprise a flexible or compliant material, such as, for instance, an elastomer or other polymer. In one embodiment, shock absorbing member 125 may comprise a nitrile rubber. Utilizing a shock absorbing member 125 between the traveling sleeve 128 and sealing portion 126 of the uplock sleeve 124 may reduce or prevent deformation of at least one of the traveling sleeve 128 and sealing portion 126 of the uplock sleeve 124 that may otherwise occur due to impact therebetween.

It should be noted that any sealing elements (e.g., seals, seal rings, etc.) or shock absorbing members disclosed herein that are included within expandable reamer apparatus 100 may comprise any suitable material as known in the art, such as, for instance, a polymer or elastomer. Optionally, a material comprising a sealing element may be selected for relatively high temperature (e.g., about 400° Fahrenheit or greater) use. For example, seals may be comprised of a polytetrafluoroethylene (PTFE), marked commercially as TEFLON® polymers, polyetheretherketone (PEEK) material, another polymer material, or other natural or synthetic elastomer, or may comprise a metal-to-metal seal suitable for expected borehole conditions. Specifically, any sealing element or shock absorbing member disclosed herein or other sealing elements included by an expandable reamer apparatus of the invention may comprise a material configured for relatively high temperature use, as well as for use in highly corrosive borehole environments.

Referring now to FIGS. 4 and 5, the shear screws 127 of the shear assembly 150, retaining the traveling sleeve 128 and the uplock sleeve 124 in the initial position, are used to provide or create a trigger, releasing when pressure builds to a predetermined, threshold value. When the hydraulic pressure within the expandable reamer apparatus 100 is increased above a threshold level, the shear screws 127 of the shear assembly 150 will fail, thereby enabling the traveling sleeve 128 to travel in the longitudinal direction with the expandable reamer apparatus 100, as described below. The predetermined threshold value at which the shear screws 127 shear under drilling fluid pressure within expandable reamer apparatus 100 may be 1000 psi (approximately 6,895 kPa), for example, or even 2000 psi (approximately 13,780 kPa). It is recognized that the pressure may range to a greater or lesser extent than presented herein to trigger the expandable reamer apparatus 100.

The traveling sleeve 128 includes an elongated cylindrical wall. The longitudinal ends of the traveling sleeve 128 are open to enable fluid to flow through the traveling sleeve 128 between the open ends thereof. Furthermore, one or more fluid ports 173 (e.g., holes, apertures, etc.) extend laterally through the elongated cylindrical wall of the traveling sleeve 128. For example, a fluid port 173 may be provided proximate to the distal end 165 of the traveling sleeve 128, as shown in the figures. The distal end 165 of the traveling sleeve 128 includes, within its longitudinal bore, a constricted portion 129 that includes a ball trap sleeve 131. A seal 139 (e.g., an O-ring seal) may also provide a seal between the constricted portion 129 and the ball trap sleeve 131. A restriction element (e.g., the ball 147) may be introduced into the expandable reamer apparatus 100 in order to enable operation of the expandable reamer apparatus 100 to initiate or "trigger" the action of the shear assembly 150. After the ball 147 is introduced, fluid will carry the ball 147 into the constricted portion 129 and the ball 147 may be retained and sealed by the seat part of the ball trap sleeve 131 and the constricted portion 129. When the ball 147 occludes fluid flow by being trapped in the constricted portion 129, the fluid or hydraulic pressure will build up within the expandable reamer apparatus 100 until the shear screws 127 shear. After the shear screws 127 shear, the traveling sleeve 128 along with the coaxially retained seat stop sleeve 130 will axially travel, under the influence of the hydraulic pressure, in the downhole direction 157 until the traveling sleeve 128 is again axially retained by the uplock sleeve 124 as described above or moves into a lower position. Thereafter, the fluid flow may be re-established through the fluid ports 173 in the traveling sleeve 128 above the ball 147.

Optionally, the ball 147 used to activate the expandable reamer apparatus 100 and engage the constricted portion 129 and the ball trap sleeve 131 may include malleable characteristics, such that the ball 147 may deform therein as it seats in order to prevent the ball 147 from moving around and potentially causing problems or damage to the expandable reamer apparatus 100.

After the traveling sleeve 128 travels sufficiently far enough to enable the dogs 166 of the lowlock sleeve 117 to be disengaged from the groove 167 of the tubular body 108, the dogs 166 of the lowlock sleeve 117 being connected to the push sleeve 115 may all move in the uphole direction 159. In order for the push sleeve 115 to move in the uphole direction 159, the differential pressure between the longitudinal bore 151 and the outer surface 111 of the tubular body 108 caused by the hydraulic fluid flow must be sufficient to overcome the restoring force or bias of the spring 116. The spring 116 that resists the motion of the push sleeve 115 in the uphole direction 159, may be retained on an outer surface 175 of the push sleeve 115 between a ring 113 attached in a shouldered portion 174 of the tubular body 108 and the lowlock sleeve 117. The push sleeve 115 may axially travel in the uphole direction 159 under the influence of the hydraulic fluid, but is restrained from moving beyond the top lip of the ring 113. The push sleeve 115 may include a seal 137 (e.g., a T-seal) that seals against the traveling sleeve 128 and a wiper seal 141 that seals against the traveling sleeve 128 and push sleeve 115.

As shown in FIG. 4, in some embodiments, the expandable reamer apparatus 100 may include a lowlock sleeve 117 that is sized and positioned to preload the spring 116. As discussed above, the spring 116 may resist the motion of the push sleeve 115 in the uphole direction 159 and may be retained on the outer surface 175 of the push sleeve 115 between the ring 113 attached in the shouldered portion 174 of the tubular body 108 and the lowlock sleeve 117. The lowlock sleeve 117 may be sized and positioned in the tubular body 108 about the traveling sleeve 128 such that the spring 116 is preloaded (i.e., compressed) between the lowlock sleeve 117 and the ring 113. In other words, the distance between the lowlock sleeve 117 and the ring 113 in the tubular body 108 is less than the distance of the spring 116 in its uncompressed state. When the spring 116 is inserted into the tubular body 108 a force is applied to the spring 116 to compress it between the lowlock sleeve 117 and the ring 113. The preloaded spring 116 will bias the push sleeve 115 into its initial position such that once the drilling fluid is ceased (i.e., after the expandable reamer apparatus 100 is returned to a retracted state after being in an extended state by reducing the drilling fluid flow) the preloaded spring 116 will reposition the push sleeve 115 with a force relatively greater than that of a non-preloaded spring. In some embodiments, the lowlock sleeve 117 may be coupled to the push sleeve 115 such that a distal end of the lowlock sleeve 117 is proximate to a distal end of the push sleeve 115 and may preload the spring 116.

Figure 10:
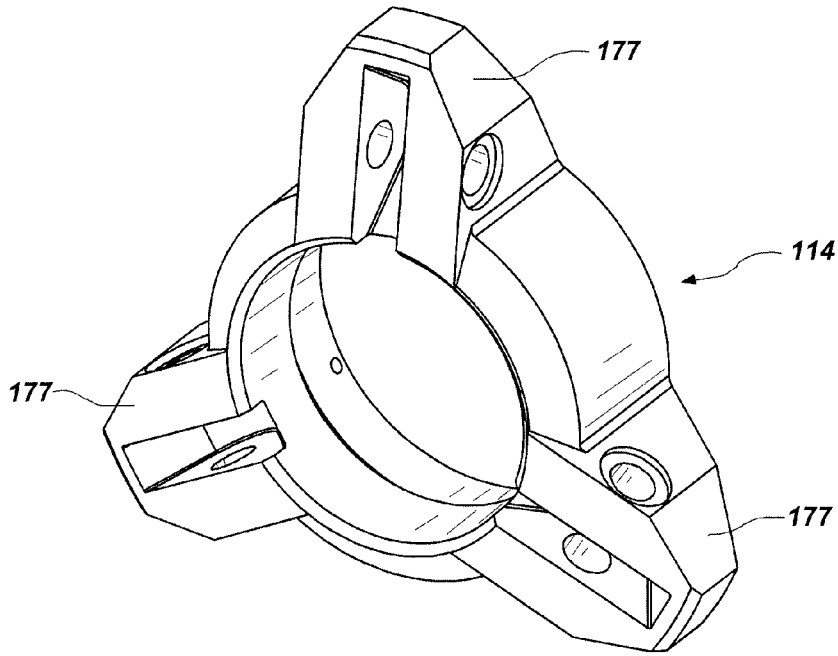
FIG. 10 shows a perspective view of a yoke of an embodiment of an expandable reamer apparatus.

As shown in FIG. 5, the push sleeve 115 includes, at its proximal end, a yoke 114 coupled thereto. The yoke 114 (also shown in greater detail in FIG. 10) includes three arms 177, each arm 177 being coupled to one of the blades 101 by a pinned linkage 178. The arms 177 may include a shaped surface suitable for expelling debris as the blades 101 are retracted toward the retracted position. The shaped surface of the arms 177, in conjunction with the adjacent wall of the cavity of the tubular body 108, may provide included angles of approximately twenty (20) degrees, which is preferable to dislodge and remove any packed-in shale, and may further include low friction surface material to prevent sticking by formation cuttings and other debris. The pinned linkage 178 includes a linkage 118 coupling one of the blades 101 to the arm 177, where the linkage 118 is coupled to one of the blades 101 by a blade pin 119 and secured by a retaining ring 142, and the linkage 118 is coupled to the arm 177 by a yoke pin 120. The pinned linkage 178 enables the blades 101 to rotationally transition about the arms 177 of the yoke 114, particularly as the actuating means (e.g., the push sleeve 115, the yoke 114, and the linkage 178) directly transitions the blades 101 between the extended and retracted positions. In some embodiments, the actuating means may directly retract as well as extend the blades 101.

In order that the blades 101 may transition between the extended and retracted positions, the blades 101 are each positionally coupled to one of the blade tracks 148 in the tubular body 108 as particularly shown in FIG. 2. The blade track 148 includes a dovetail-shaped groove 179 that axially extends along the tubular body 108 on a slanted slope 180 having an acute angle with respect to the longitudinal axis $L_8$. Each of the blades 101 include a dovetail-shaped rail 181 (FIG. 2) that substantially matches the dovetail-shaped groove 179 of the blade track 148 in order to slidably secure the blades 101 to the tubular body 108. When the push sleeve 115 is influenced by the hydraulic pressure, the blades 101 will be extended upward and outward through a blade passage port 182 into the extended position ready for cutting the formation. The blades 101 are pushed along the blade tracks 148 until the forward motion is stopped by the tubular body 108 (e.g., stopped by the upper hardfaced pads 105 on the stabilizer block coupled to the tubular body 108). In the upward and outward (i.e., fully extended position), the blades 101 are positioned such that the cutting elements 104 will enlarge a borehole in the subterranean formation by a prescribed amount. When hydraulic pressure provided by drilling fluid flow through expandable reamer apparatus 100 is released, the spring 116 will urge the blades 101 via the push sleeve 115 and the pinned linkage 178 into the retracted position. Should the assembly not readily retract via spring force, the tool may be pulled up the borehole and abutted against a casing shoe. When the tool is pulled against a casing shoe, the shoe may contact the blades 101 helping to urge or force them down the tracks 148, enabling the expandable reamer apparatus 100 to be retrieved from the borehole. In this respect, the expandable reamer apparatus 100 includes a retraction assurance feature to further assist in removing the expandable reamer apparatus from a borehole.

Figure 6:
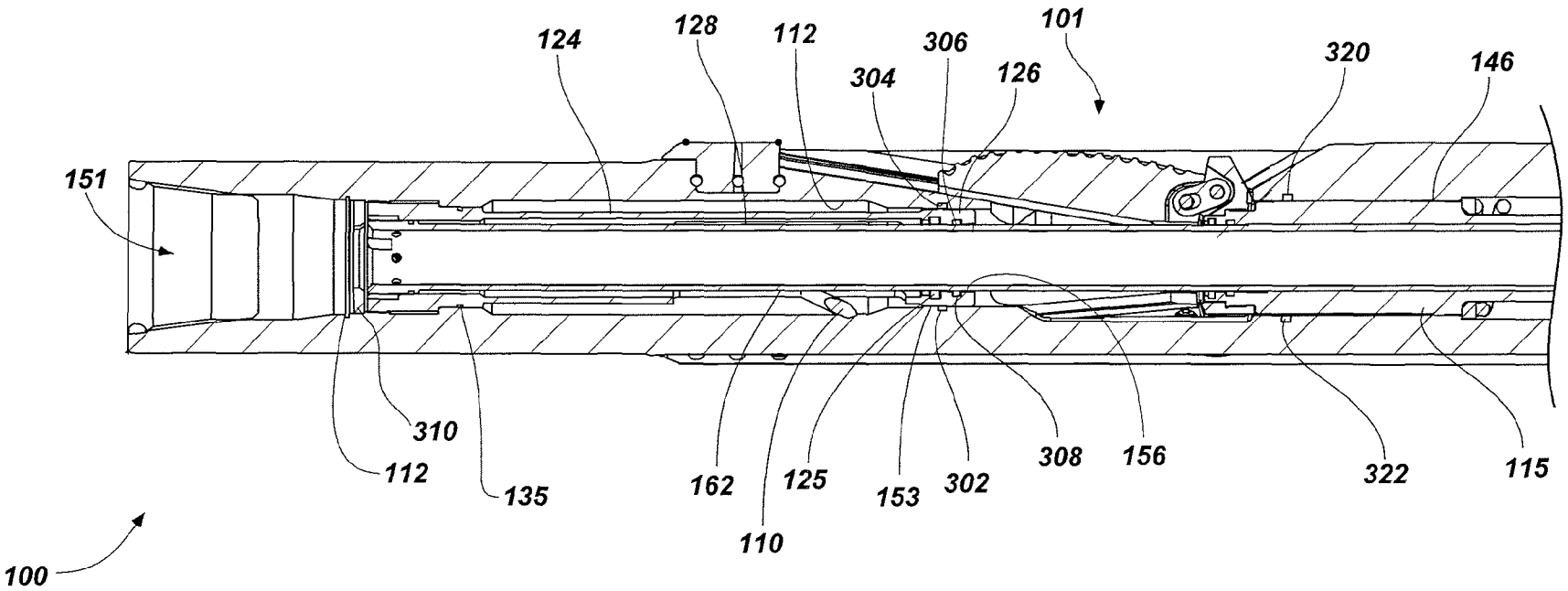
FIG. 6 shows an enlarged cross-sectional view of a portion of an expandable reamer apparatus in accordance with another embodiment of the present invention.

As shown in FIG. 6, the expandable reamer apparatus 100 may include an uplock sleeve 124 that extends from a proximal end of the traveling sleeve 128 to a location proximate to one of the blades 101. For example, the uplock sleeve 124 may be coupled to the traveling sleeve 128 and may secure the traveling sleeve 128 from axially moving within the tubular body 108 of the expandable reamer apparatus 100 while in the initial position (e.g., before the ball 147 (FIG. 4) is placed in the expandable reamer apparatus 100). The uplock sleeve 124 may include a distal portion (e.g., the sealing portion 126) of the uplock sleeve 124. The sealing portion 126 may include one or more seal rings to seal prevent the flow of drilling fluid through elements of the expandable reamer apparatus 100. For example, the sealing portion 126 may include a first seal ring 302 disposed between an outer surface 153 of the uplock sleeve 124 and the inner surface 112 of the tubular body 108. The first seal ring 302 may form a seal between the outer surface 153 of the uplock sleeve 124 and the inner surface 112 of the tubular body 108 in order to prevent drilling fluid from passing between the uplock sleeve 124 and the tubular body 108. In some embodiments, the inner surface 112 of the tubular body 108 may include a first channel 304 and the first seal ring 302 may be disposed in the first channel 304. The sealing portion 126 of the uplock sleeve 124 may also include a second seal ring 306 disposed between an inner surface 156 of the uplock sleeve 124 and an outer surface 162 of the traveling sleeve 128. The second seal ring 306 may form a seal between the inner surface 156 of the uplock sleeve 124 and the outer surface 162 of the traveling sleeve 128 in order to prevent drilling fluid from passing between the uplock sleeve 124 and the traveling sleeve 128. In some embodiments, the inner surface 156 of the uplock sleeve 124 may include a second channel 308 and the second seal ring 306 may be disposed in the second channel 308.

In some embodiments, the second seal ring 306 and the seal 135 located on the proximal end of the uplock sleeve 124 may prevent drilling fluid from flowing to a nozzle assembly 110 when the uplock sleeve 124 and the traveling sleeve 128 are in the initial position (i.e., while the uplock sleeve 124 is retaining the traveling sleeve 128). In other words, the seal 135 and second seal ring 306 may prevent drilling fluid from flowing between the outer surface 153 of the uplock sleeve 124 and the longitudinal bore 151 of the tubular body 108.

In some embodiments, the sealing portion 126 of the uplock sleeve 124 may also include the shock absorbing member 125 on the inner surface 156 of the uplock sleeve 124. As discussed above, the shock absorbing member 125 may mitigate impact shock caused by the traveling sleeve 128 when its motion is stopped by the uplock sleeve 124.

In some embodiments, the sealing portion 126 may axially align, guide, and support the traveling sleeve 128 within the tubular body 108. The seal rings 302, 306 may also prevent hydraulic fluid from leaking from within the expandable reamer apparatus 100 to outside the expandable reamer apparatus 100 by way of the nozzle intake port 164 prior to the traveling sleeve 128 being released from its initial position.

In the initial position (i.e., before the shear screws 127 are sheared enabling the traveling sleeve 128 to move within the tubular body 108), a proximal end of the uplock sleeve 124 may be adjacent to a proximal end of the traveling sleeve 128. For example, the expandable reamer apparatus 100 may include a spacer 310 disposed in the longitudinal bore 151 of the tubular body 108. In the initial position, the proximal end of the uplock sleeve 124 may be adjacent to the proximal end of the traveling sleeve 128 and the proximal ends of both the uplock sleeve 124 and the traveling sleeve 128 may abut the spacer 310. In some embodiments, after the traveling sleeve 128 has been released from the uplock sleeve 124 (i.e., after the expandable reamer apparatus 100 has been triggered), the proximal end of the uplock sleeve 124 may continue to abut the spacer 310.

Referring still to FIG. 6, the expandable reamer apparatus 100 may include a body sealing ring 320 (e.g., a POLYPAK® seal) disposed in the inner surface 112 of the tubular body 108 proximate to an actuation structure (e.g., the push sleeve 115). In some embodiments, the inner surface 112 of the tubular body 108 may include a channel 322 and the body sealing ring 320 may be partially disposed in the channel 322. The body sealing ring 320 may be disposed in the inner surface 112 of the tubular body 108 and may abut with the outer surface 146 (e.g., a precision sealing surface) of the push sleeve 115 to prevent fluid from flowing between the inner surface 112 of the tubular body 108 and may abut with an outer surface 146 of the push sleeve 115.

Figure 8:
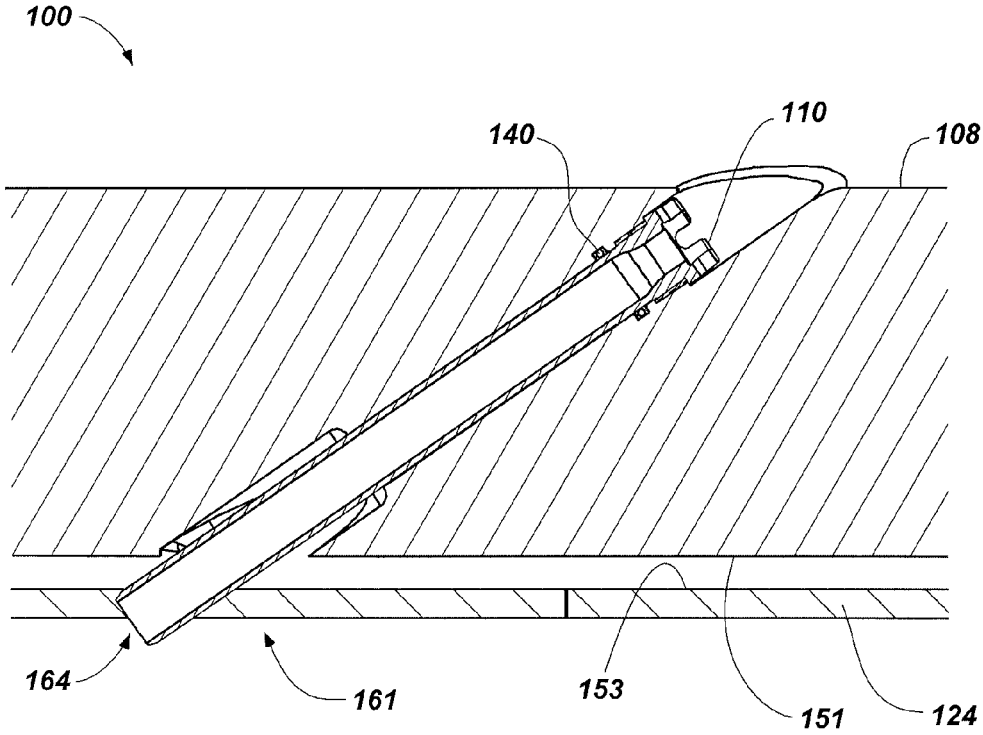
FIG. 8 shows a cross-sectional view of a nozzle assembly of an embodiment of an expandable reamer apparatus.

Referring now to FIG. 8, the expandable reamer apparatus 100 may include nozzle assemblies 110 (e.g., tungsten carbide nozzles). The nozzle assemblies 110 may be provided to cool and clean the cutting elements 104 and clear debris from blades 101 (FIG. 6) during drilling. The nozzle assemblies 110 may include a seal 140 (e.g., an O-ring seal) between each nozzle assembly 110 and the tubular body 108 to provide a seal between the two components. As shown, the assemblies 110 are configured to direct drilling fluid towards the blades 101 (FIG. 2) in the downhole direction 157, but may be configured to direct fluid laterally or in the uphole direction 159.

In some embodiments, a nozzle intake port 164 of the nozzle assemblies 110 may extend into the longitudinal bore 151 of the expandable reamer apparatus 100. For example, the nozzle intake port 164 of each of the nozzle assemblies 110 may extend past the longitudinal bore 151 of the expandable reamer apparatus 100 and through the one or more ports 161 formed in the uplock sleeve 124. As discussed above, as the traveling sleeve 128 is positioned a sufficient axial distance in the downhole direction 157, the one or more ports 161 of the uplock sleeve 124 enable fluid to communicate with a nozzle intake port 164 from the fluid passageway 192 (FIG. 2). As shown in FIG. 8, the nozzle assembly 110 may extend to and, in some embodiments, into the longitudinal bore 151 of the expandable reamer apparatus 100 and may also extend into the uplock sleeve 124 through the one or more ports 161 formed in the uplock sleeve 124. The nozzle intake port 164 of the nozzle assembly 110 may be positioned in the fluid channel between the longitudinal bore 151 of the expandable reamer apparatus 100 and the outer surface 153 of the uplock sleeve 124. In some embodiments, the nozzle intake port 164 of the nozzle assembly 110 may extend a distance (e.g., 0.2 inch (5.08 millimeters)) taken from an edge of the nozzle assembly 110 to the inner wall 112 of the tubular body 108. Extending the nozzle assemblies 110 to or into the longitudinal bore 151 of the expandable reamer apparatus 100 may limit the erosion of elements of the expandable reamer apparatus 100 caused by the drilling fluid. For example, extending the nozzle assemblies 110 to or into the longitudinal bore 151 may reduce destructive fluid flow patterns (e.g., wormhole propagation) around the nozzle intake port 164 that may cause damage to the tubular body 108 of the expandable reamer apparatus 100.

The nozzle assemblies 110 may be directed in the direction of flow through the expandable reamer apparatus 100 from within the tubular body 108 downward and outward radially to the annulus between tubular body 108 and a borehole. Directing the nozzle assemblies 110 in such a downward direction causes counterflow as the flow exits the nozzle assembly 110 and mixes with the annular moving counter flow returning up the borehole and may improve blade cleaning and cuttings removal. The nozzle assemblies 110 are directed at the cutters of the blades 101 for maximum cleaning, and may be directionally optimized using computational fluid dynamics (CFD) analysis.

Referring now to FIGS. 11 through 15, the expandable reaming apparatus, or reamer, 100 is now described in terms of its operational aspects. The expandable reamer apparatus 100 may be installed in a bottom-hole assembly above a pilot bit and, if included, above or below the measurement while drilling (MWD) device and incorporated into a rotary steerable system (RSS) and rotary closed loop system (RCLS), for example. Before "triggering" the expandable reamer apparatus 100 to the expanded position, the expandable reamer apparatus 100 is maintained in an initial, retracted position as shown in FIG. 11. For example, the traveling sleeve 128 within the expandable reamer apparatus 100 prevents inadvertent extension of blades 101, as previously described, and is retained by the shear assembly 150 with shear screws 127 secured to the uplock sleeve 124, which is attached to the tubular body 108. While the traveling sleeve 128 is held in the initial position, the blade actuating means is prevented from directly actuating the blades 101 whether acted upon by biasing forces or hydraulic forces. The traveling sleeve 128 has, on its distal end, an enlarged end piece (e.g., the seat stop sleeve 130). This larger diameter seat stop sleeve 130 holds the dogs 166 of the lowlock sleeve 117 in a secured position, preventing the push sleeve 115 from moving upward under affects of differential pressure and activating the blades 101. The latch dogs 166 lock the latch or expandable detent 168 into a groove 167 in the longitudinal bore 151 of the tubular body 108. When it is desired to trigger the expandable reamer apparatus 100, drilling fluid flow is momentarily ceased, if required, and a ball 147, or other fluid restricting element, is dropped into the drill string and pumping of drilling fluid resumed. The ball 147 moves in the downhole direction 157 under the influence of gravity, the flow of the drilling fluid, or a combination thereof.

Figure 12:
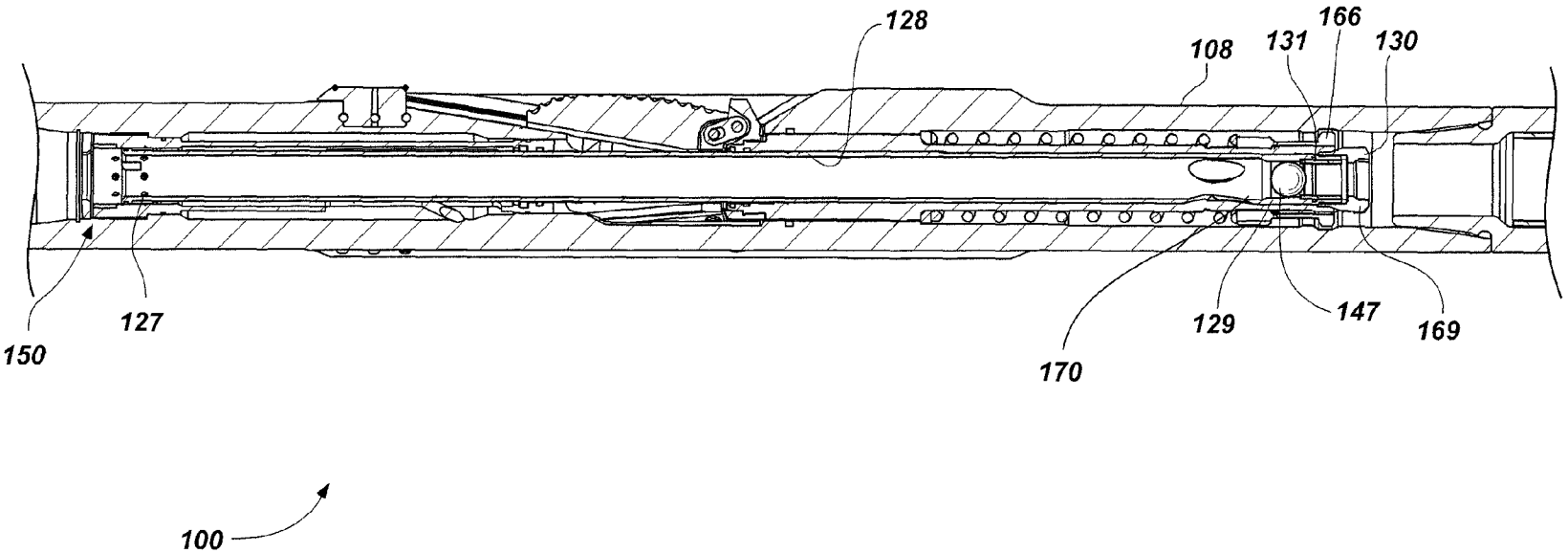
FIG. 12 shows a partial, longitudinal cross-sectional illustration of the expandable reamer apparatus of FIG. 11 in the initial tool position prior to actuation of the blades.

As shown in FIG. 12, the ball 147 reaches a ball seat of the constricted portion 129. The ball 147 stops drilling fluid flow and causes pressure to build above the ball 147 in the drill string. As the pressure builds, the ball 147 may be further seated into or against the ball trap sleeve 131 as the force of the drilling fluid on the ball 147 may deform the ball 147, the ball trap sleeve 131, or a combination thereof. At a predetermined pressure level, set by the number and individual shear strengths of the shear screws 127 (made of brass or other suitable material) installed initially in the expandable reamer apparatus 100, the shear screws 127 will fail in the shear assembly 150 and enable the traveling sleeve 128 to unseal and move downward. As the traveling sleeve 128 with the larger outer diameter 169 of the seat stop sleeve 130 moves downward, the latch dogs 166 of the lowlock sleeve 117 are free to move inward toward the smaller outer diameter 170 of the traveling sleeve 128 and become free of the tubular body 108.

Figure 13:
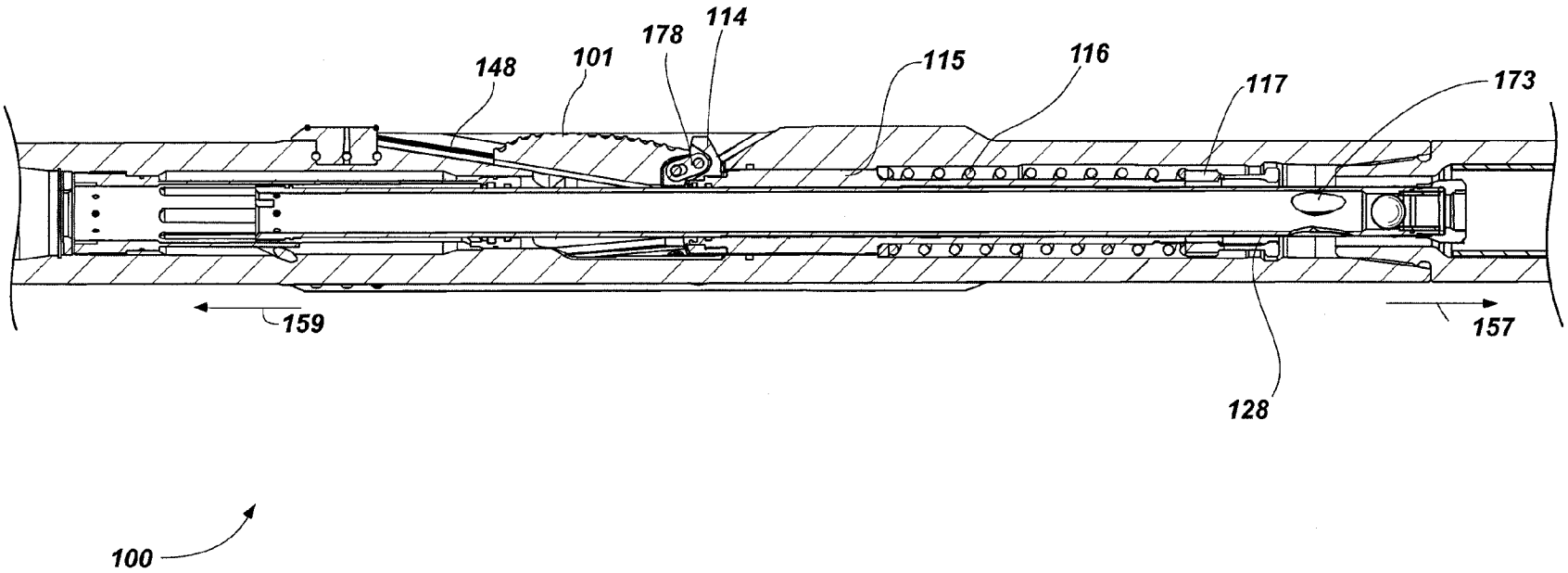
FIG. 13 shows a partial, longitudinal cross-sectional illustration of the expandable reamer apparatus of FIG. 11 in which a shear assembly is triggered as pressure is accumulated and a traveling sleeve begins to move down within the apparatus, leaving the initial tool position.

Thereafter, as illustrated in FIG. 13, the lowlock sleeve 117 coupled to the pressure-activated push sleeve 115 may move in the uphole direction 159 under fluid pressure influence through the fluid ports 173 as the traveling sleeve 128 moves in the downhole direction 157. As the fluid pressure is increased, the biasing force of the spring 116 is overcome enabling the push sleeve 115 to move in the uphole direction 159. The push sleeve 115 is attached to the yoke 114 which is attached by pins and linkage 178 to the three blades 101, which are now moved upwardly by the push sleeve 115. In moving upward, the blades 101 each follow a ramp or blade track 148 to which they are mounted (e.g., via a type of modified square dovetail groove 179 (FIG. 2)).

Figure 14:
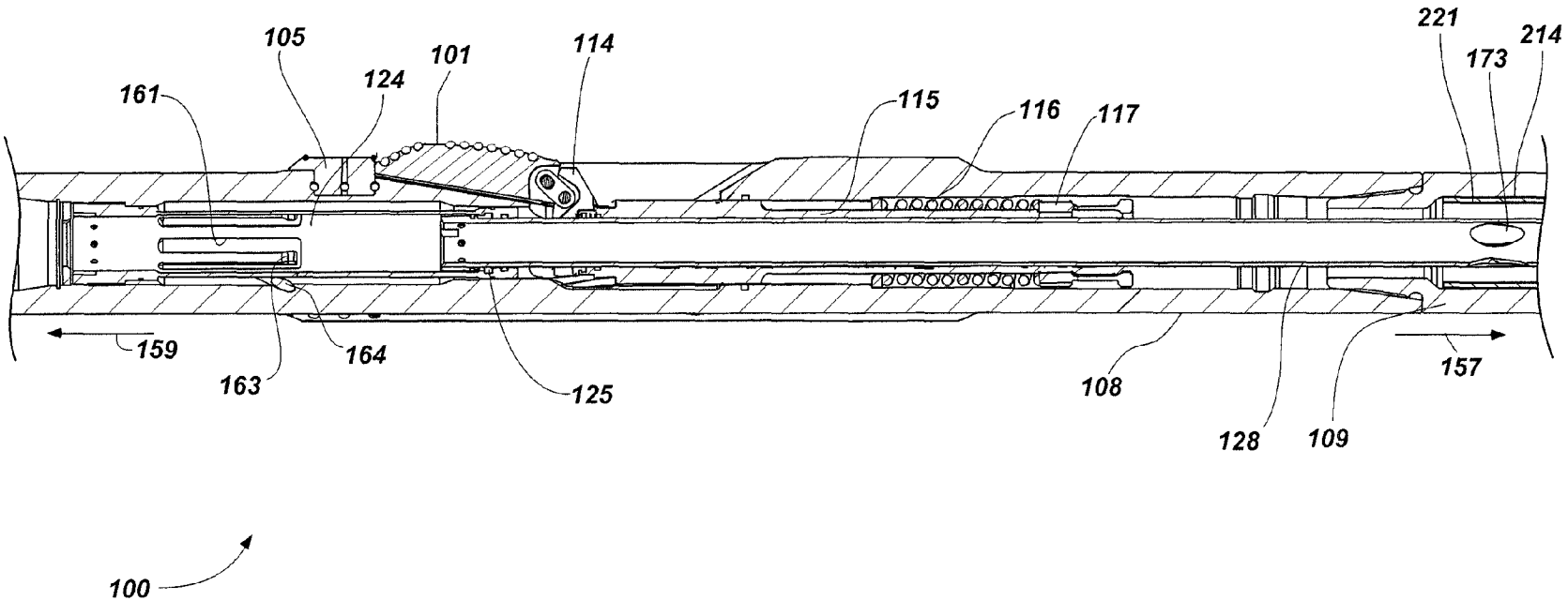
FIG. 14 shows a partial, longitudinal cross-sectional illustration of the expandable reamer apparatus of FIG. 11 in which the traveling sleeve moves toward a lower, retained position while a blade (one depicted) being urged by a push sleeve under the influence of fluid pressure is moved to an extended position.

As shown in FIG. 14, the stroke of the blades 101 may be stopped in the fully extended position by upper hardfaced pads 105 on the stabilizer block, for example. Optionally, as mentioned herein above, a customized stabilizer block may be assembled to the expandable reamer apparatus 100 prior to drilling in order to adjust and limit the extent to which the blades 101 may extend. In some embodiments, the thickness of the blades 101 (i.e., a dimension of the blades 101 taken in a lateral direction of the expandable reamer apparatus 100) may be varied in order to provide a desired borehole diameter during the reaming process. With the blades 101 in the extended position, reaming a borehole may commence.

As reaming takes place with the expandable reamer apparatus 100, the mid and lower hardfaced pads 106, 107 (FIG. 1) may help to stabilize the tubular body 108 as the cutting elements 104 of the blades 101 ream a larger borehole and the upper hardfaced pads 105 (FIG. 1) may also help to stabilize the top of the expandable reamer 100 when the blades 101 are in the retracted position.

After the traveling sleeve 128 moves downward, it comes to a stop with the fluid ports 173 in the traveling sleeve 128 exiting against an inside wall 214 of the lower sub 109. In some embodiments, the inside wall 214 of the lower sub 109 may include a hardfaced protect sleeve 221, which may help to prevent or minimize erosion damage from drilling fluid flow impinging thereupon. The proximal end of the traveling sleeve 128 may abut with a portion of the uplock sleeve 124. For example, the traveling sleeve 128 may abut with the sealing portion 126 of the uplock sleeve 124 and the shock absorbing member 125 of the uplock sleeve 124.

Figure 15:
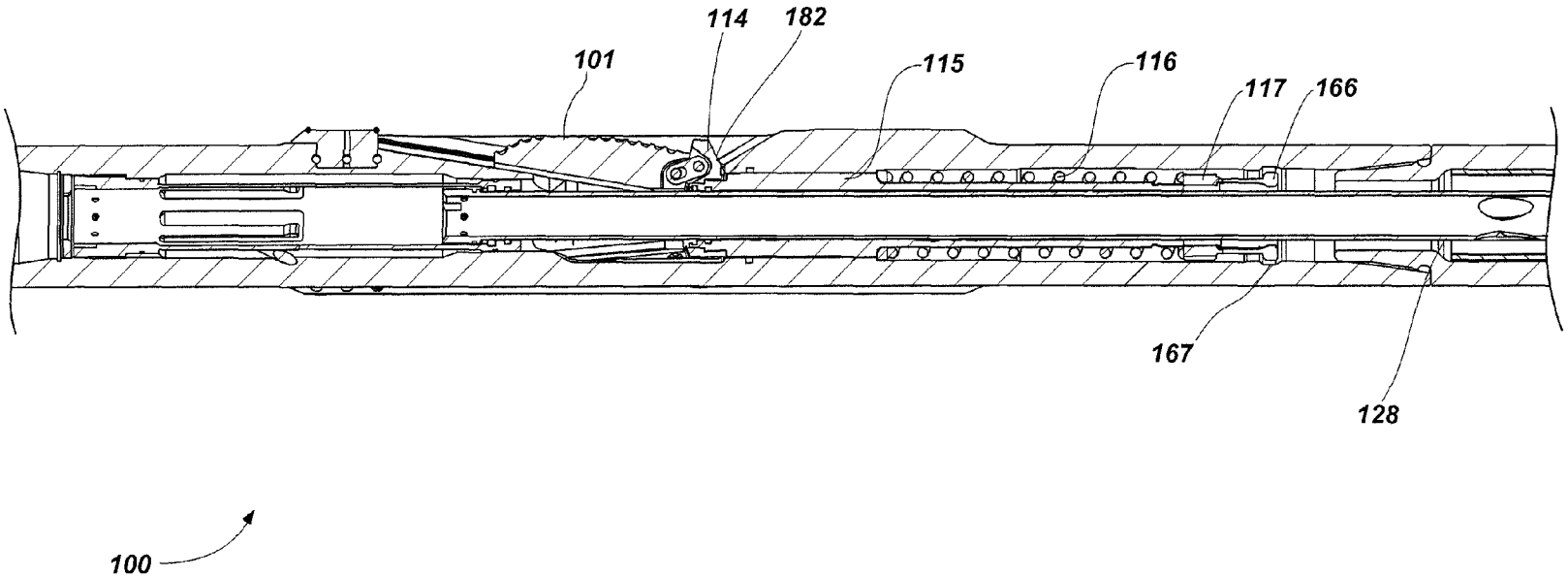
FIG. 15 shows a partial, longitudinal cross-sectional illustration of the expandable reamer apparatus of FIG. 11 in which the blades (one depicted) are retracted into a retracted position by a biasing spring when the fluid pressure is dissipated.

When drilling fluid pressure is released, the spring 116 will help drive the lowlock sleeve 117 and the push sleeve 115 with the attached blades 101 back downwardly and inwardly substantially to their original initial position (e.g., the retracted position), as shown in FIG. 15. However, since the traveling sleeve 128 has moved to a downward locked position, the larger diameter seat stop sleeve 130 (FIG. 13) will no longer hold the dogs 166 out and in the groove 167, and, thus, the latch or lowlock sleeve 117 stays unlatched for subsequent operation.

Whenever the flow rate of the drilling fluid passing through the traveling sleeve 128 is elevated to or beyond a selected flow rate value, the push sleeve 115 with the yoke 114 and blades 101 may move upward with the blades 101 following the blade tracks 148 to again ream the prescribed larger diameter in a borehole. Whenever the flow rate of the drilling fluid passing through the traveling sleeve 128 is below a selected flow rate value (i.e., the differential pressure falls below the restoring force of the spring 116), the blades 101 may retract, as described above, via the spring 116.

In other embodiments of the invention, the traveling sleeve 128 may be sealed to prevent fluid flow from exiting the tool through the blade passage ports 182, and after triggering, the seal may be maintained.

While particular embodiments of the invention have been shown and described, numerous variations and other embodiments will occur to those skilled in the art. Accordingly, it is intended that the invention only be limited in terms of the appended claims and their legal equivalents.

What is claimed:

1. An expandable apparatus for use in a subterranean borehole, comprising:

a tubular body having at least one opening extending between a longitudinal bore of the tubular body and an outer surface of the tubular body;

at least one member positioned within the at least one opening of the tubular body, the at least one member configured to move between a retracted position and an extended position;

a push sleeve disposed within the longitudinal bore of the tubular body and coupled to the at least one member, the push sleeve configured to move the at least one member from the retracted position to the extended position responsive to a flow rate of drilling fluid passing through the longitudinal bore;

a traveling sleeve positioned within the longitudinal bore of the tubular body and partially within the push sleeve, the traveling sleeve configured to secure the push sleeve from axial movement within the tubular body in an initial position;

an uplock sleeve coupled to the tubular body, the uplock sleeve configured to secure the traveling sleeve from axial movement within the tubular body in the initial position, wherein a proximal end of the uplock sleeve is positioned adjacent to a proximal end of the traveling sleeve in the initial position; and a lower sub coupled to the tubular body, the lower sub having a longitudinal bore sized and configured to enable the traveling sleeve to translate through the longitudinal bore of the tubular body and into the longitudinal bore of the lower sub and wherein a portion of the traveling sleeve is configured to travel into the lower sub.

2. The expandable apparatus of claim 1, wherein the expandable apparatus comprises at least one of an expandable reamer apparatus and an expandable stabilizer apparatus.

3. The expandable apparatus of claim 1, wherein a portion of the longitudinal bore of the lower sub has a diameter greater than a diameter of the longitudinal bore of the tubular body.

4. The expandable apparatus of claim 1, wherein a proximal end of the lower sub is coupled to a distal end of the tubular assembly proximate to a distal end of the traveling sleeve.

5. The expandable apparatus of claim 1, further comprising a preloaded spring disposed within the longitudinal bore of the tubular body and abutting a portion of the push sleeve, wherein, in the initial position, the preloaded spring biases the push sleeve and the at least one member coupled thereto toward the retracted position.

6. The expandable apparatus of claim 5, wherein the expandable apparatus comprises at least one of an expandable reamer apparatus and an expandable stabilizer apparatus.

7. The expandable apparatus of claim 5, wherein the preloaded spring abuts a lowlock sleeve coupled the push sleeve, wherein the lowlock sleeve is engaged with the tubular body and is positioned in the tubular body to preload the preloaded spring in the initial position, and wherein the push sleeve is axially transitionable after the lowlock sleeve has released from engagement with the tubular body in the extended position.

8. The expandable apparatus of claim 5, wherein a distal end of the lowlock sleeve is proximate to a distal end of the push sleeve.

9. An expandable apparatus for use in a subterranean borehole, comprising:

a tubular body having at least one opening extending between a longitudinal bore of the tubular body and an outer surface of the tubular body;

at least one member positioned within the at least one opening of the tubular body, the at least one member configured to move between a retracted position and an extended position;

a push sleeve disposed within the longitudinal bore of the tubular body and coupled to the at least one member, the push sleeve configured to move the at least one member from the retracted position to the extended position responsive to a flow rate of drilling fluid passing through the longitudinal bore;

a traveling sleeve positioned within the longitudinal bore of the tubular body and partially within the push sleeve, the traveling sleeve configured to secure the push sleeve from axial movement within the tubular body in an initial position;

an uplock sleeve coupled to the traveling sleeve, the uplock sleeve configured to secure the traveling sleeve from axial movement within the tubular body in the initial position and wherein a distal portion of the uplock sleeve comprises a sealing portion disposed between an outer surface of the traveling sleeve and an inner surface of the tubular body, the sealing portion comprising a first seal ring disposed between the sealing portion of the uplock sleeve and the outer surface of the traveling sleeve; and the tubular body further comprising a channel having a second seal ring disposed therein, the second seal ring located between the inner surface of the tubular body and the outer surface of the sealing portion of the uplock sleeve.

10. The expandable apparatus of claim 9, wherein the expandable apparatus comprises at least one of an expandable reamer apparatus and an expandable stabilizer apparatus.

11. The expandable apparatus of claim 9, further comprising:

a nozzle assembly positioned in the tubular body proximate to the at least one member; and a third seal ring disposed in the uplock sleeve on a proximal side of the nozzle assembly, wherein the second seal ring is disposed on a distal side of the nozzle assembly, and wherein the first seal ring, the second seal ring, and the third seal ring substantially prevent drilling fluid from flowing to the nozzle assembly in the initial position.

12. The expandable apparatus of claim 11, further comprising at least one port formed in the uplock sleeve between the first seal ring and the third seal ring, the at least one port configured to direct fluid flow from a fluid passageway to at least one nozzle assembly in an extended position.

13. The expandable apparatus of claim 9, wherein a proximal end of the uplock sleeve is adjacent to a proximal end of the traveling sleeve in the initial position.

14. The expandable apparatus of claim 13, further comprising a spacer disposed in the longitudinal bore of the tubular body, the spacer abutting the proximal end of the uplock sleeve and the proximal end of the traveling sleeve in the initial position and the spacer abutting the proximal end of the uplock sleeve in an expanded position.

15. An expandable apparatus for use in a subterranean borehole, comprising:

a tubular body having at least one opening extending between a longitudinal bore of the tubular body and an outer surface of the tubular body;

at least one member positioned within the at least one opening of the tubular body, the at least one member configured to move between a retracted position and an extended position;

an actuation structure positioned within the tubular body, the actuation structure coupled to the at least one member and configured to move the at least one member from the retracted position to the extended position responsive to a flow rate of drilling fluid passing through the longitudinal bore; and at least one nozzle assembly positioned in the tubular body proximate to the at least one member, the at least one nozzle assembly extending into the longitudinal bore of the tubular body.

16. The expandable apparatus of claim 15, wherein the expandable apparatus comprises at least one of an expandable reamer apparatus and an expandable stabilizer apparatus.

17. The expandable apparatus of claim 15, wherein the at least one nozzle assembly comprises a plurality of nozzle assemblies, each nozzle assembly of the plurality of nozzle assemblies extending into the longitudinal bore of the tubular body.

18. The expandable apparatus of claim 15, wherein the at least one nozzle assembly extends from the outer surface of the tubular body proximate to the at least one member, through a passageway in the tubular body, and into the longitudinal bore of the tubular body.

19. The expandable apparatus of claim 15, further comprising an uplock sleeve for axially retaining the traveling sleeve, the uplock sleeve having at least one port formed therein configured to direct fluid flow from a fluid passageway to the at least one nozzle assembly.

20. The expandable apparatus of claim 19, wherein the at least one nozzle assembly extends through the at least one port formed in the uplock sleeve.

21. An expandable apparatus for use in a subterranean borehole, comprising:

a tubular body having at least one opening extending between a longitudinal bore of the tubular body and an outer surface of the tubular body;

at least one member positioned within the at least one opening of the tubular body, the at least one member configured to move between a retracted position and an extended position;

an actuation structure positioned within the tubular body, the actuation structure coupled to the at least one member and configured to move the at least one member from the retracted position to the extended position responsive to a flow rate of drilling fluid passing through the longitudinal bore;

a traveling sleeve positioned within the longitudinal bore of the tubular body and partially within the actuation structure, the traveling sleeve configured to secure the actuation structure from axial movement within the tubular body in an initial position; and an uplock sleeve coupled to the tubular body, the uplock sleeve configured to secure the traveling sleeve from axial movement within the tubular body in the initial position, wherein a proximal end of the uplock sleeve is adjacent to a proximal end of the traveling sleeve in the initial position.

22. The expandable apparatus of claim 21, wherein the expandable apparatus comprises at least one of an expandable reamer apparatus and an expandable stabilizer apparatus.

23. The expandable apparatus of claim 22, wherein the actuation structure comprises a push sleeve disposed within the longitudinal bore of the tubular body and coupled to the at least one member.

24. The expandable apparatus of claim 21, further comprising a spacer disposed in the longitudinal bore of the tubular body, the spacer abutting the proximal end of the uplock sleeve and the proximal end of the traveling sleeve in the initial position and the spacer abutting the proximal end of the uplock sleeve in an expanded position.

* * * * *